US007455393B2

(12) United States Patent
Onozawa

(10) Patent No.: US 7,455,393 B2
(45) Date of Patent: Nov. 25, 2008

(54) MIST SPRAYING APPARATUS AND METHOD, AND IMAGE FORMING APPARATUS

(75) Inventor: Sho Onozawa, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 434 days.

(21) Appl. No.: 11/376,151

(22) Filed: Mar. 16, 2006

(65) Prior Publication Data

US 2006/0209129 A1 Sep. 21, 2006

(30) Foreign Application Priority Data

Mar. 18, 2005 (JP) ..... 2005-080165

(51) Int. Cl.
*B41J 2/06* (2006.01)

(52) U.S. Cl. ..... 347/55; 347/15; 347/68

(58) Field of Classification Search ..... 347/15, 347/20, 44, 47, 55, 57–59, 60, 68, 70–71, 347/74–78, 83
See application file for complete search history.

(56) References Cited

U.S. PATENT DOCUMENTS 4,281,333 A * 7/1981 Tsuzuki et al. ..... 347/15
6,623,113 B2 * 9/2003 Yamada et al. ..... 347/77

FOREIGN PATENT DOCUMENTS

JP 62-85948 A 4/1987
JP 62-111757 A 5/1987
JP 2-134250 A 5/1990
JP 5-57891 A 3/1993

OTHER PUBLICATIONS

Kameyama et al., Journal of the Acoustical Society of Japan, vol. 60, No. 2, 2004, pp. 53-60.
Fukumoto et al., Japan Hardcopy '99 Collected Essays, 1999, pp. 343-346.

* cited by examiner

*Primary Examiner*—Juanita D Stephens
(74) *Attorney, Agent, or Firm*—Birch, Stewart, Kolasch & Birch, LLP

(57) ABSTRACT

The mist spraying apparatus comprises: a pressure chamber into which liquid is filled; a charging electrode which is in contact with the liquid and charges the liquid; a vibration generating device which converts the liquid into droplets by applying vibrational energy to the liquid inside the liquid chamber, thereby generating a charged mist; a rear surface electrode which is disposed so as to oppose an ejection surface including an ejection port ejecting the charged mist, and holds an liquid receiving medium onto which the charged mist is deposited from the ejection port; an acceleration electrode which is disposed at a position separated by a prescribed distance in an outward radial direction from an edge of the ejection port, and generates an electric field for acceleration between the acceleration electrode and the opposing rear surface electrode; a charging voltage application device which applies a charging voltage to the charging electrode; and an acceleration voltage application device which applies an acceleration voltage that is higher than the charging voltage to the acceleration electrode, thereby generating, between the acceleration electrode and the rear surface electrode, the electric field for acceleration having an electric field intensity which is greater than an electric field intensity generated between the charging electrode and the rear surface electrode by the voltage applied from the charging voltage application device.

11 Claims, 14 Drawing Sheets

37
HIGH
42
40
A
12
34
32

37
LOW
24
40
A
12
34
32

MIST SPRAYING APPARATUS AND METHOD, AND IMAGE FORMING APPARATUS

BACKGROUND OF THE INVENTION

1. Field of the Invention

The present invention relates to a mist spraying apparatus and method, and an image forming apparatus, and more particularly to an apparatus and method for spraying a liquid in the form of a mist, by using ultrasonic waves, and to an image forming apparatus which records images by means of a group of ink micro-particles (ink mist) sprayed as a mist.

2. Description of the Related Art

There is an ink mist type of image recording apparatus (ink mist printer) which records images by generating a flow of ink mist (very fine ink particles) by means of ultrasonic vibration, and depositing this ink mist onto a recording medium as a group (cluster), (see, for example, Japanese Patent Application Publication Nos. 62-85948, 62-111757, 2-134250 and 5-57891). Furthermore, a composition of a print head using concentrated ultrasonic waves and nozzles has also been proposed ("Study on Ink Ejection of Print Head Using Focused Ultrasonic Wave and Nozzle" (Shumpei Kameyama, Hiroshi Fukumoto, and Shusou Wadaka, Journal of the Acoustical Society of Japan, Vol. 60, No. 2, (2004), pp. 53-60)), and "Multi-Level Ink Jet Printing with Mist Jet Ejected by Focused Ultrasonic Waves", Hiroshi Fukumoto, et. al., Japan Hardcopy '99 Collected Essays).

Since the mist is a collection (cluster) of fine liquid droplets, it is highly subject to variations caused by prolongation in the flight time of the liquid droplets due to the effects of air resistance, and disturbance by external air flows. Therefore, a device is used to accelerate the movement of the fine liquid droplets forming the mist cluster by charging the droplets and applying an electric field (see Japanese Patent Application Publication Nos. 62-85948 and 62-111757, for example), but in this case, the mist cluster expands due to the occurrence of a Coulomb repulsion effect between the charged fine liquid droplets, and therefore it is essentially impossible to avoid enlargement of the dot diameter when the ink lands on the medium. In mist systems in the related art, there are many compositions which use the same electrode pair for charging and accelerating the liquid droplets, but in compositions of this kind, if the applied voltage is raised in order to shorten the flight time by applying an acceleration energy, then the amount of charge on the liquid droplets is also increased proportionately, and hence the dot diameter becomes larger due to increased Coulomb repulsion between the fine liquid droplets. This results in the deposition performance actually becoming worse.

SUMMARY OF THE INVENTION

The present invention has been contrived in view of the foregoing circumstances, an object thereof being to provide a mist spraying apparatus and method, and an image forming apparatus using same, whereby enlargement of the dot diameter can be suppressed by increasing the acceleration energy of the mist while suppressing the amount of charge on the mist.

In order to attain the aforementioned object, the present invention is directed to a mist spraying apparatus, comprising: a pressure chamber into which liquid is filled; a charging electrode which is in contact with the liquid and charges the liquid; a vibration generating device which converts the liquid into droplets by applying vibrational energy to the liquid inside the liquid chamber, thereby generating a charged mist; a rear surface electrode which is disposed so as to oppose an ejection surface including an ejection port ejecting the charged mist, and holds an liquid receiving medium onto which the charged mist is deposited from the ejection port; an acceleration electrode which is disposed at a position separated by a prescribed distance in an outward radial direction from an edge of the ejection port, and generates an electric field for acceleration between the acceleration electrode and the opposing rear surface electrode; a charging voltage application device which applies a charging voltage to the charging electrode; and an acceleration voltage application device which applies an acceleration voltage that is higher than the charging voltage to the acceleration electrode, thereby generating, between the acceleration electrode and the rear surface electrode, the electric field for acceleration having an electric field intensity which is greater than an electric field intensity generated between the charging electrode and the rear surface electrode by the voltage applied from the charging voltage application device.

According to the present invention, the charging function and the acceleration function are separated spatially by providing the charging electrode and the acceleration electrode separately, and furthermore, the acceleration voltage which is higher than the charging voltage is applied, whereby the acceleration energy is raised while restricting the amount of charge. Consequently, the Coulomb repulsion force between the very fine liquid droplets is suppressed, and enlargement of the dot size is prevented, while at the same time, the deposition performance can be improved. Suitable values are established for the charging voltage and the acceleration voltage on the basis of conditions such as the apparatus conditions, such as the electrode arrangement structure (for example, the distance between the electrodes), the desired dot size and the desired flight time, and the like.

Preferably, a nozzle plate in which the ejection port is formed functions as the charging electrode. According to this aspect of the present invention, the ejection ports are formed in the actual charging electrode, and the charging electrode is in contact with the meniscus in the ejection ports. By applying the charging voltage to the nozzle plate (charging electrode), electrons are induced to the surface of the liquid and the liquid becomes charged.

Preferably, an insulating layer is provided between the charging electrode and the acceleration electrode.

By interposing the insulating member between the charging electrode and the acceleration electrode, and electrically insulating the respective electrodes, it is possible reliably to separate the electrode functions.

Preferably, the vibration generating device is constituted by a piezoelectric element; and a drive control device is provided to output a drive signal which causes the piezoelectric element to vibrate ultrasonically.

The piezoelectric element is suitable for use as a device for generating the vibrational energy required to convert the liquid into a mist.

In order to attain the aforementioned object, the present invention is also directed to a mist spraying apparatus, comprising: a pressure chamber into which liquid is filled; a charging and acceleration electrode which is in contact with the liquid and selectively applies a charging voltage for charging the liquid, and an acceleration voltage which generates an acceleration electric field for accelerating a charged mist ejected from an ejection port; a vibration generating device which converts the liquid into droplets by applying vibrational energy to the liquid inside the liquid chamber, thereby generating the charged mist; a rear surface electrode which is disposed so as to oppose an ejection surface including the ejection port ejecting the charged mist, and holds a liquid receiving medium onto which the charged mist is deposited from the ejection port; a voltage application device which selectively applies the charging voltage and the acceleration voltage that is higher than the charging voltage, to the charging and acceleration electrode; and an electric field control device which controls, by temporal division, the voltage applied to the charging and acceleration electrode by the voltage application device, thereby generating an electric field of a first electric field intensity between the charging and acceleration electrode and the rear surface electrode, during application of the charging voltage, and generating an acceleration electric field of a second electric field intensity that is greater than the first electric field intensity, between the charging and acceleration electrode and the rear surface electrode, during application of the acceleration voltage.

According to the present invention, the electrode which serves as both the charging electrode and the acceleration electrode (i.e., the charging and acceleration electrode) is provided, and control for switching the applied voltage to the electrode by temporal division is implemented, in such a manner that the charging function and the acceleration function are separated temporally, by selectively applying the charging voltage and the acceleration voltage. By applying the charging voltage of a relatively low voltage during charging, and applying the acceleration voltage of a relatively high voltage during acceleration, the acceleration energy is raised, while restricting the amount of charge on the mist. Consequently, the Coulomb repulsion force between the very fine liquid droplets is suppressed, and enlargement of the dot size is prevented, while at the same time, the deposition performance can be improved.

Preferably, a nozzle plate in which the ejection port is formed functions as the charging and acceleration electrode.

According to this aspect of the present invention, the ejection ports are formed in the actual charging and acceleration electrode, and the charging and acceleration electrode is in contact with the meniscus in the ejection ports. By applying a charging voltage to the nozzle plate (charging and acceleration electrode), electrons are induced to the surface of the liquid and the liquid becomes charged.

In order to attain the aforementioned object, the present invention is also directed to an image forming apparatus comprising the above-described mist spraying apparatus, which forms an image on the liquid receiving medium by means of the droplets ejected from the ejection ports.

The driving of the vibration generating device is controlled on the basis of the input image data, and the charged mist (liquid droplets) is ejected from the ejection ports. The cluster of charged mist thus ejected is accelerated by the electrostatic force of the acceleration electric field and is deposited on the liquid receiving medium. In this way, a dot is formed by a mist cluster deposited on the liquid receiving medium. By controlling the ejection timing and the ejection volume of the liquid droplets in accordance with the image data, it is possible to record a desired image (dot arrangement) on the liquid receiving medium. According to the image forming apparatus of the present invention, formation of high-quality and high-speed images becomes possible.

In order to achieve a high-resolution image output, a desirable mode is one using a mist ejection head in which a plurality of ejection elements (liquid chamber units) are arranged, each constituted by an ejection port which ejects liquid droplets, a pressure chamber corresponding to the ejection port, and a vibration generating device. In this case, a charging electrode, an acceleration electrode or a charging and acceleration electrode, is provided on the ejection surface of the mist ejection head.

A compositional embodiment of a mist ejection head is a full line type mist ejection head having a nozzle row in which a plurality of ejection ports (nozzles) are arranged through a length corresponding to the full width of the liquid receiving medium.

In this case, a mode may be adopted in which a plurality of relatively short ejection head modules having nozzles rows which do not reach a length corresponding to the full width of the liquid receiving medium are combined and joined together, thereby forming nozzle rows of a length that correspond to the full width of the liquid receiving medium.

A full line type mist ejection head is usually disposed in a direction perpendicular to the relative feed direction (relative conveyance direction) of the recording medium, but modes may also be adopted in which the mist ejection head is disposed following an oblique direction that forms a prescribed angle with respect to the direction perpendicular to the relative conveyance direction.

When forming color images, it is possible to provide full line type print heads for each color of a plurality of colored inks, or it is possible to eject recording inks of a plurality of colors, from one print head.

The "liquid receiving medium" is a medium which receives the deposition of liquid ejected from the ejection ports, and in an image forming apparatus, this corresponds to a recording medium, such as recording paper. More specifically, the "liquid receiving medium" indicates a recording medium, print medium, image forming medium, image receiving medium, or the like. This term includes various types of media, irrespective of material and size, such as continuous paper, cut paper, sealed paper, resin sheets, such as OHP sheets, film, cloth, a printed circuit board on which a wiring pattern, or the like, is formed, and an intermediate transfer medium, and the like.

The conveyance device for causing the liquid receiving medium and the mist ejection head to move relative to each other may include a mode where the liquid receiving medium is conveyed with respect to a stationary (fixed) head, or a mode where a head is moved with respect to a stationary liquid receiving medium, or a mode where both the head and the liquid receiving medium are moved.

In order to attain the aforementioned object, the present invention is also directed to a mist spraying method, comprising the steps of: charging liquid filled in a liquid chamber by applying a charging voltage to a charging electrode which is in contact with the liquid, and generating a charged mist by converting the liquid into droplets by applying a vibrational energy to the liquid; ejecting the charged mist from an ejection port toward a liquid receiving medium held on a rear surface electrode disposed so as to oppose an ejection surface including the ejection port of the charged mist; generating, between an acceleration electrode and the rear surface electrode, an acceleration electric field of an electric field intensity greater than an electric field intensity generated between the charging electrode and the rear surface electrode, by applying an acceleration voltage that is higher than the charging voltage, to the acceleration electrode which is separated by a prescribed distance in an outward radial direction from an edge of the ejection port; and depositing the charged mist on the liquid receiving medium, by accelerating the charged mist by means of electrostatic force of the acceleration electric field.

In order to attain the aforementioned object, the present invention is also directed to a mist spraying method, comprising the steps of: charging liquid filled in a liquid chamber by applying a charging voltage to a charging and acceleration electrode which is in contact with the liquid, and generating a charged mist by converting the liquid into droplets by applying a vibrational energy to the liquid; ejecting the charged mist from an ejection port toward a liquid receiving medium held on a rear surface electrode disposed so as to oppose an ejection surface including the ejection port of the charged mist; controlling a voltage applied to the charging and acceleration electrode, by temporal division, and thereby selectively applying the charging voltage, and an acceleration voltage that is higher than the charging voltage, to the charging and acceleration electrode; generating an electric field of a first electric field intensity between the charging and acceleration electrode and the rear surface electrode, during application of the charging voltage, and generating an acceleration electric field of a second electric field intensity that is greater than the first electric field intensity, between the charging and acceleration electrode and the rear surface electrode, during application of the acceleration voltage; and depositing the charged mist on the liquid receiving medium, by accelerating the charged mist by means of electrostatic force of the acceleration electric field.

According to the present invention, the functions of charging and acceleration are separated either spatially or temporally, and the acceleration energy is raised while suppressing the amount of charge on the mist. Therefore, it is possible to improve the deposition performance while suppressing enlargement of the dot diameter.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Spatial Division Method

Figure 1:
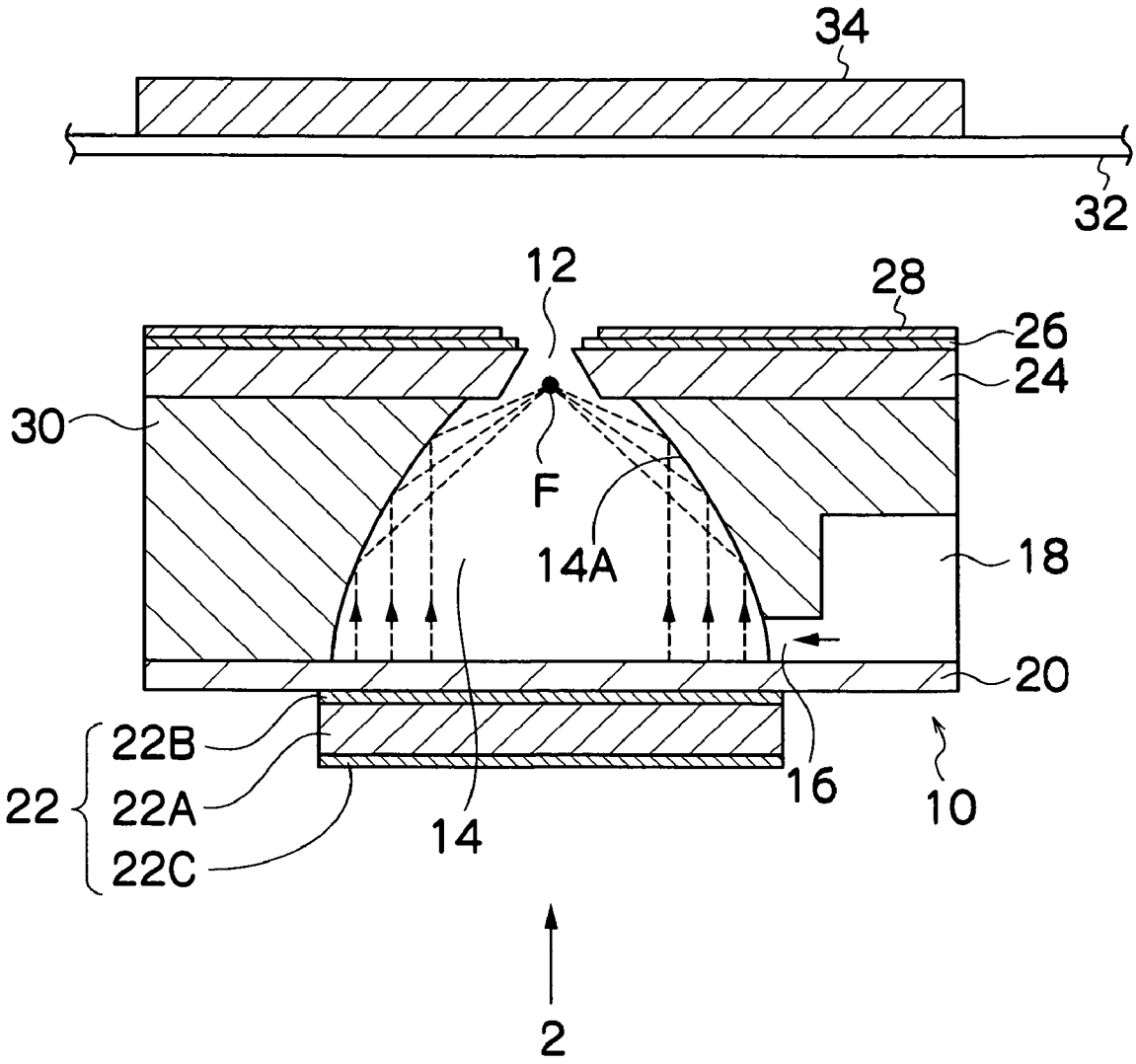
FIG. 1 is a cross-sectional diagram showing the basic composition of a mist spraying apparatus according to a first embodiment of the present invention.

FIG. 1 is a cross-sectional diagram showing the basic composition of a mist spraying apparatus according to a first embodiment of the present invention. The mist spraying apparatus 10 shown in FIG. 1 includes a nozzle 12, an ink chamber 14, an ink supply port 16, a common flow channel 18 which accommodates ink to be supplied to the ink chamber 14, an insulating resin film 20, and a piezoelectric element 22. FIG. 1 shows a cross-sectional view of an ink chamber unit corresponding to one nozzle 12 (the liquid droplet ejection element for one channel). When applied to a mist ejection head, such as a print head (also called a "recording head"), or the like, a structure comprising a plurality of channels arranged one-dimensionally (in a column shape) or two-dimensionally (in a plane shape) is adopted.

The nozzle plate 24 in which the nozzles (ejection ports) 12 are formed is constituted by a conducting material, such as metal, and also serves as an electrode for charging the ink liquid (hereinafter, called "charging electrode"). An electrode film (hereinafter, called "acceleration electrode") 28 is arranged on the ejection surface of the nozzle plate 24 (reverse to the surface adjacent to the ink chamber 14; namely, the upper side in FIG. 1) through an insulating film 26.

The inner circumferential face of the ink chamber 14 has a parabolic shape, and an ink chamber forming plate 30 and the nozzle plate 24 are bonded together in such a manner that the center of the opening on the ink chamber 14 side of the nozzle 12 is located at the focal point F of the parabolic surface 14A. The parabolic surface 14A forms a reflecting plate reflecting ultrasonic waves generated by the piezoelectric element 22, and therefore, in order to achieve high reflectivity, it is desirable to use a metal material for the ink chamber forming plate 30.

The resin film 20 is arranged on the side of the ink chamber forming plate 30 reverse to the nozzle plate 24, and is bonded to the ink chamber forming plate 30 in a composition which seals off one face of the ink chamber 14 (the bottom face in FIG. 1). Ink introduced from the common flow channel 18 through the ink supply port 16 is filled into the space (ink chamber 14) surrounded by the parabolic surface 14A, the resin film surface 20, and the nozzle plate 24.

Figure 2:
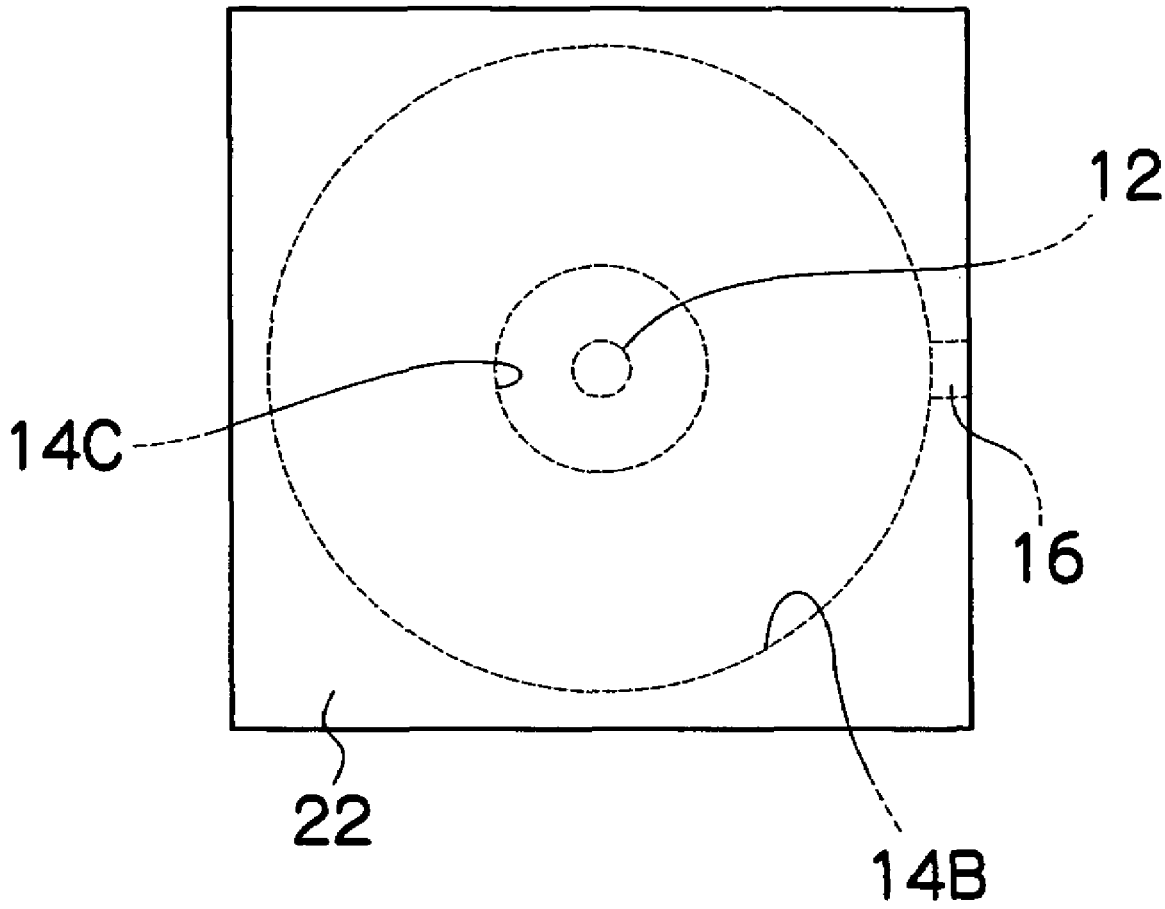
FIG. 2 is a plan diagram viewed in the direction of arrow 2 in FIG. 1.

The piezoelectric element 22 functions as a vibrating element and is bonded on the surface (the lower surface in FIG. 1) of the resin film 20 reverse to the surface thereof adjacent to the ink chamber 14. FIG. 2 shows a plan diagram of the piezoelectric element 22 (a view in the direction of the arrow 2 in FIG. 1). As shown in FIG. 2, the piezoelectric element 22 has a surface area which covers the upstream side opening 14B of the parabolic surface 14A. FIG. 2 shows an embodiment comprising a substantially square-shaped piezoelectric element 22 having a surface area larger than the upstream side opening 14B of the parabolic surface 14A, but the planar shape of the piezoelectric element 22 is not limited to being a square shape, and it may also be another quadrilateral shape, such as a rectangular or rhombic shape, or a hexagonal shape, octagonal shape, or other polygonal shape, or a circular or elliptical shape, or the like. In FIG. 2, the dotted circle denoted with the reference numeral 14C is the downstream side opening of the parabolic surface 14A (the edge of the opening which is in contact with the nozzle plate 24) (see FIG. 1).

As shown in FIG. 1, the piezoelectric element 22 has a structure in which electrodes 22B and 22C are formed on either surface of a piezoelectric body 22A. In the embodiment shown in FIG. 1, the electrode 22B on the side bonded to the resin film 20 is a common electrode, and the electrode 22C on the other side is an independent drive electrode (hereinafter, called "individual electrode").

In this composition, by applying a high-frequency drive signal (drive voltage) to the individual electrode 22C of the piezoelectric element 22, the piezoelectric element 22 is made to vibrate and generate an ultrasonic wave. The resin film 20 vibrates in conjunction with the piezoelectric element 22, due to its flexibility, and hence the ultrasonic wave radiates into the ink through the resin film 20.

The ultrasonic wave radiating into the ink from the piezoelectric element 22 propagates through the ink chamber 14, through the medium of the ink, and converges in the vicinity of the focal point F (in the vicinity of the central region of the nozzle 12), due to reflection at the parabolic surface 14A. FIG. 1 shows a schematic diagram in which the directions of travel of the wave fronts of the pressure waves having the ultrasonic frequency are indicated by broken lines. Due to the energy of the concentrated ultrasonic wave, a capillary wave intrinsic to the frequency is generated in the liquid surface (meniscus) in the nozzle section 12, and fine droplets of the ink become separated from the wave peaks in the minute surface wave thus created. Consequently, a collection of fine particles of the ink in the form of a mist (a mist cluster) is sprayed from the nozzle 12.

A recording medium 32, which is typically a sheet of recording paper, is conveyed while maintaining a uniform distance from the nozzle surface. A flat plate-shaped rear surface electrode 34 is disposed on the rear surface of the recording medium 32 (reverse to the recording surface on which ink particles are deposited), and the recording medium 32 is held (supported) by the rear surface electrode 34. By applying a DC voltage (charging voltage V1) between the rear surface electrode 34 and the nozzle plate 24 (the charging electrode), the ink liquid in the nozzle section is charged with a positive charge. Furthermore, by applying a DC voltage (acceleration voltage V2), which is higher than the charging voltage V1, between the rear surface electrode 34 and the acceleration electrode 28, an electric field (acceleration electric field) is generated between the electrodes 34 and 28, and the charged mist cluster sprayed from the nozzle 12 is accelerated by the resulting electrostatic force and is deposited onto the recording medium 32.

Figure 3:
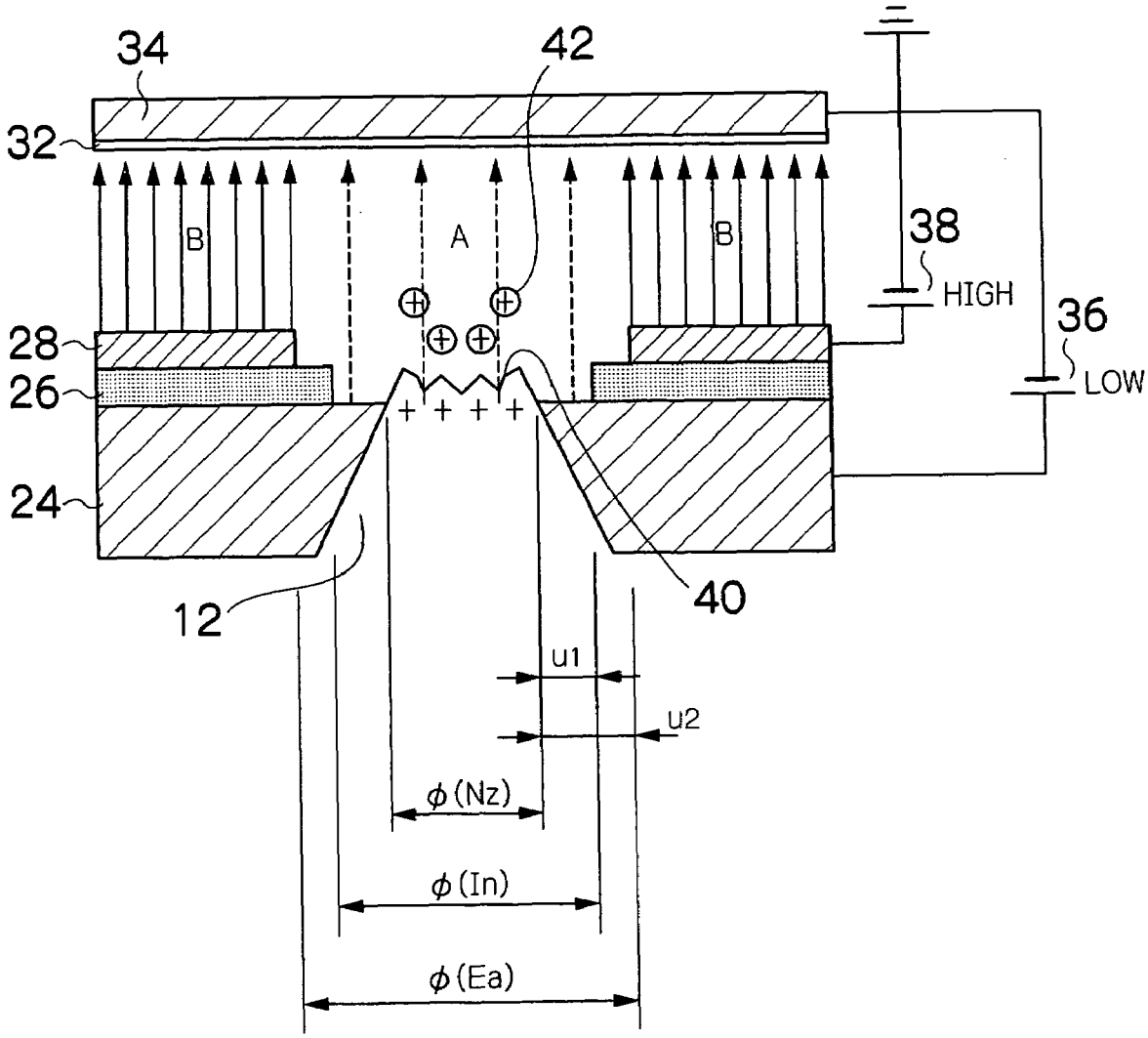
FIG. 3 is an enlarged diagram showing a schematic view of the nozzle section.

FIG. 3 is an enlarged diagram showing a schematic view of the nozzle section. As shown in FIG. 3, the hole of the nozzle 12 formed in the nozzle plate 24 has a tapered shape, whereby the cross-sectional area (hole diameter) gradually decreases in the ink ejection direction (the upward direction in FIG. 3).

On the ejection surface side of the nozzle plate 24 (the upper surface in FIG. 3), the insulating film 26 is formed around the opening of the nozzle 12, separated by a prescribed distance of u1 in an outward radial direction, from the edge of the opening of the nozzle 12. In other words, the insulating film 26 is not formed inside a region in the plane of the nozzle plate 24 from the edge of the opening of the nozzle 12 up to the prescribed distance u1 from the nozzle edge, and in this region, the surface of the nozzle plate 24 (the electrode surface of the charging electrode) is exposed. Furthermore, the acceleration electrode 28 is provided on top of the insulating film 26. The acceleration electrode 28 is formed separated from the edge of the opening of the nozzle 12 by a prescribed distance of u2 (where u1<u2) in an outward radial direction, in the plane of the nozzle plate 24.

In other words, the opening section of the insulating film 26 (region where there is no insulating film 26) and the opening section of the acceleration electrode 28 (region where there is no acceleration electrode 28) are formed concentrically about the center of the opening of the nozzle 12, and taking the diameter of the opening of the nozzle 12 to be $\Phi(Nz)$, the diameter of the opening of the insulating film 26 to be $\Phi(In)$, and the diameter of the opening of the acceleration electrode 28 to be $\Phi(Ea)$, the relationship $\Phi(Nz)<\Phi(In)<\Phi(Ea)$ is satisfied.

Suitable numerical values are designed for the prescribed distances u1 and u2, on the basis of the relationship between various design conditions, such as the nozzle diameter, the nozzle pitch, the distance to the rear surface electrode 34, the applied voltage, and the like.

The earthed rear surface electrode 34 is disposed in parallel with the nozzle plate 24 and the electrode surface of the acceleration electrode 28, and the rear surface electrode 34 functions as the opposing electrode for the charging electrode (nozzle plate 24) and the acceleration electrode 28. As shown in FIG. 3, the positive pole of a charging power source 36 is connected to the charging electrode (nozzle plate 24), and the charging voltage V1 of a relatively low voltage is applied to same. On the other hand, the positive pole of an acceleration power source 38 is connected to the acceleration electrode 28, and the acceleration voltage V2 of a relatively high voltage (V1<V2) is applied to same. The charging power source 36 corresponds to the "charging voltage application device" of the present invention and the acceleration power source 38 corresponds to the "acceleration voltage application device" of the present invention.

By separating the charging electrode (nozzle plate 24) and the acceleration electrode 28 spatially in this manner, and making the charging voltage V1 lower than the acceleration voltage V2, namely, V1<V2, the electric field intensity EB in the region indicated by B in FIG. 3 (the electric field region corresponding to the position of the acceleration electrode 28) is made to be greater than the electric field intensity EA in the region indicated by A in FIG. 3 (the electric field region corresponding to the circle of the diameter $\Phi(In)$ covering the opening of the nozzle 12 and the adjacent portion of the nozzle plate 24 (where the electrode surface is exposed) surrounding the opening of the nozzle 12). In other words, EA<EB. The dotted arrows in the region A and the solid arrows in the region B provide a schematic representation of the lines of electrical force.

Thereby, the amount of charge on the ink micro-particles (mist) 42 ejected from the liquid surface 40 of the nozzle section 12 is restricted while the acceleration energy applied to the ink micro-particles 42 is raised. Thus, it is possible to suppress the Coulomb repulsion force between the ink micro-particles 42, while ensuring the deposition characteristics of the ink micro-particles 42 due to the electrostatic force, and therefore it is possible to minimize the enlargement of the diameter of the dots recorded onto the recording medium 32.

Figure 4:
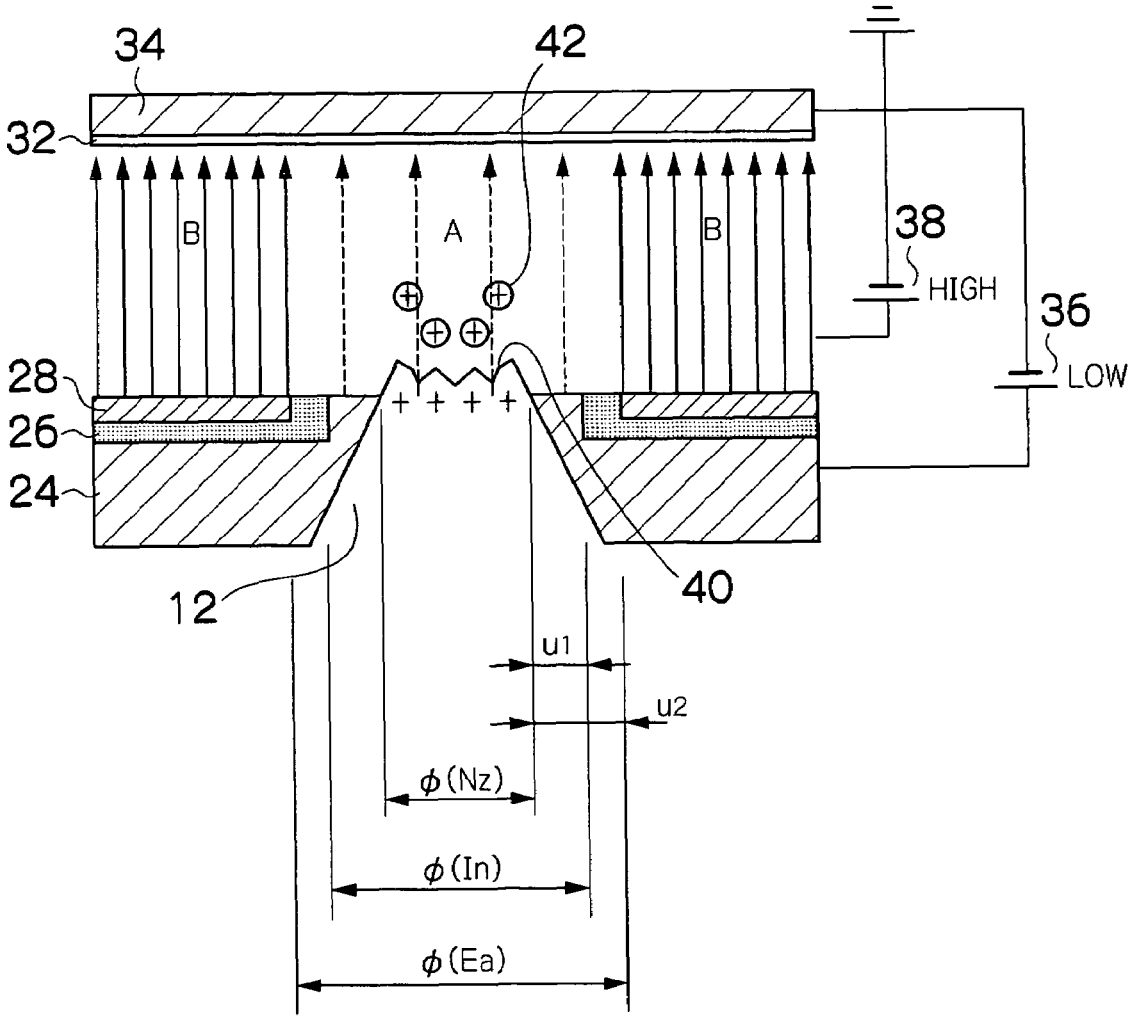
FIG. 4 is an enlarged schematic drawing showing the principal composition of a further embodiment.

FIG. 4 is an enlarged schematic drawing showing the principal composition of another embodiment. In FIG. 4, members which are the same as or similar to the composition in FIG. 3 are denoted with the same reference numerals and description thereof is omitted here.

FIG. 3 shows the structural embodiment in which the insulating film 26 and the acceleration electrode 28 are arranged in a stepwise fashion on the ejection surface side of the nozzle plate 24. On the other hand, the embodiment shown in FIG. 4 has a structure in which the insulating film 26 and the acceleration electrode 28 are embedded in the nozzle plate 24, and the electrode surface of the nozzle plate 24 which is exposed on the ejection surface, and the electrode surface of the acceleration electrode 28, are formed in the same plane without a step difference therebetween. In a mode where the structure in FIG. 4 is adopted, rather than the structure in FIG. 3, it is possible to restrict the amount of charge on the ink micro-particles (mist) 42 while increasing the acceleration energy, and hence the deposition performance of the ink micro-particles 42 is ensured due to an electrostatic force, but the Coulomb repulsion force between the ink micro-particles 42 is restricted, thereby suppressing the enlargement of the dot diameter. Moreover, since the electrodes are formed in the same plane without a step difference, then it is possible efficiently to clean away ink mist adhering to the vicinity of the nozzles, by a wiping action, or the like.

Second Embodiment

Temporal Division Method

Figures 5A, 5B:
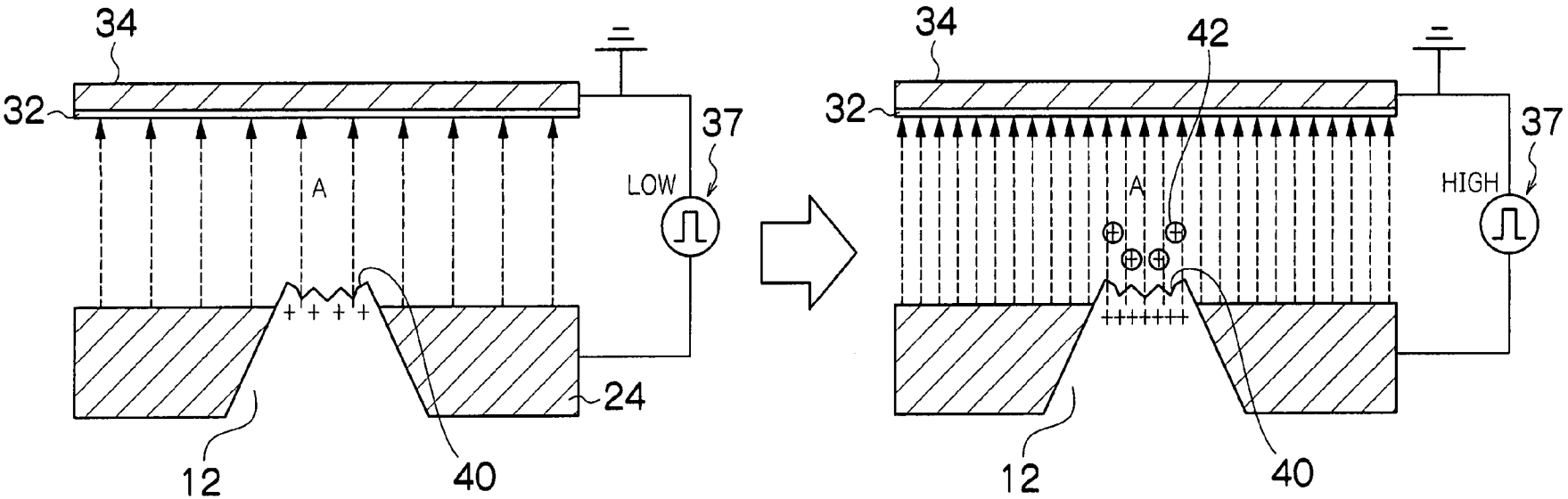
FIGS. 5A and 5B are enlarged schematic diagrams showing the principal composition of a mist spraying apparatus according to a second embodiment of the present invention.

FIGS. 5A and 5B are enlarged schematic drawings showing the principal composition of a mist spraying apparatus according to a second embodiment of the present invention. In FIGS. 5A and 5B, members which are the same as or similar to the composition in FIG. 3 are denoted with the same reference numerals and description thereof is omitted here. The embodiments shown in FIGS. 1 to 4 have the composition in which the electrode performing the charging function (nozzle plate 24), and the electrode performing the acceleration function (acceleration electrode 28) are separated spatially. On the other hand, the embodiment shown in FIGS. 5A and 5B is a mode which uses the nozzle plate 24 that serves as an electrode for both charging and acceleration (in this case, the nozzle plate corresponds to a charging and acceleration electrode), and a power source having a controllable voltage output (for example, a multi-output power source) 37, the functions of the electrode being separated temporally by means of switching the voltage applied to the nozzle plate 24.

More specifically, as shown in FIG. 5A, a low voltage (charging voltage V1) is applied to the nozzle plate 24 before ejecting the mist, thereby applying a weak charge to the ink. Thereupon, after ejection of the mist, a high voltage (acceleration voltage V2) is applied to the nozzle plate 24, thereby increasing the acceleration energy, as shown in FIG. 5B.

By separating the charging and acceleration operations by the temporal division in this way, it is possible to restrict the Coulomb repulsion force between the ink micro-particles 42, while ensuring the deposition performance of the ink micro-particles 42 due to the electrostatic force, and therefore enlargement of the dot diameter can be suppressed.

The composition of the temporal division method shown in FIGS. 5A and 5B permits a simpler composition than that of the spatial division method shown in FIGS. 1 to 4, since the acceleration electrode 28 and the insulating film 26 are not required.

Comparison of Actions and Effects

Figure 6:
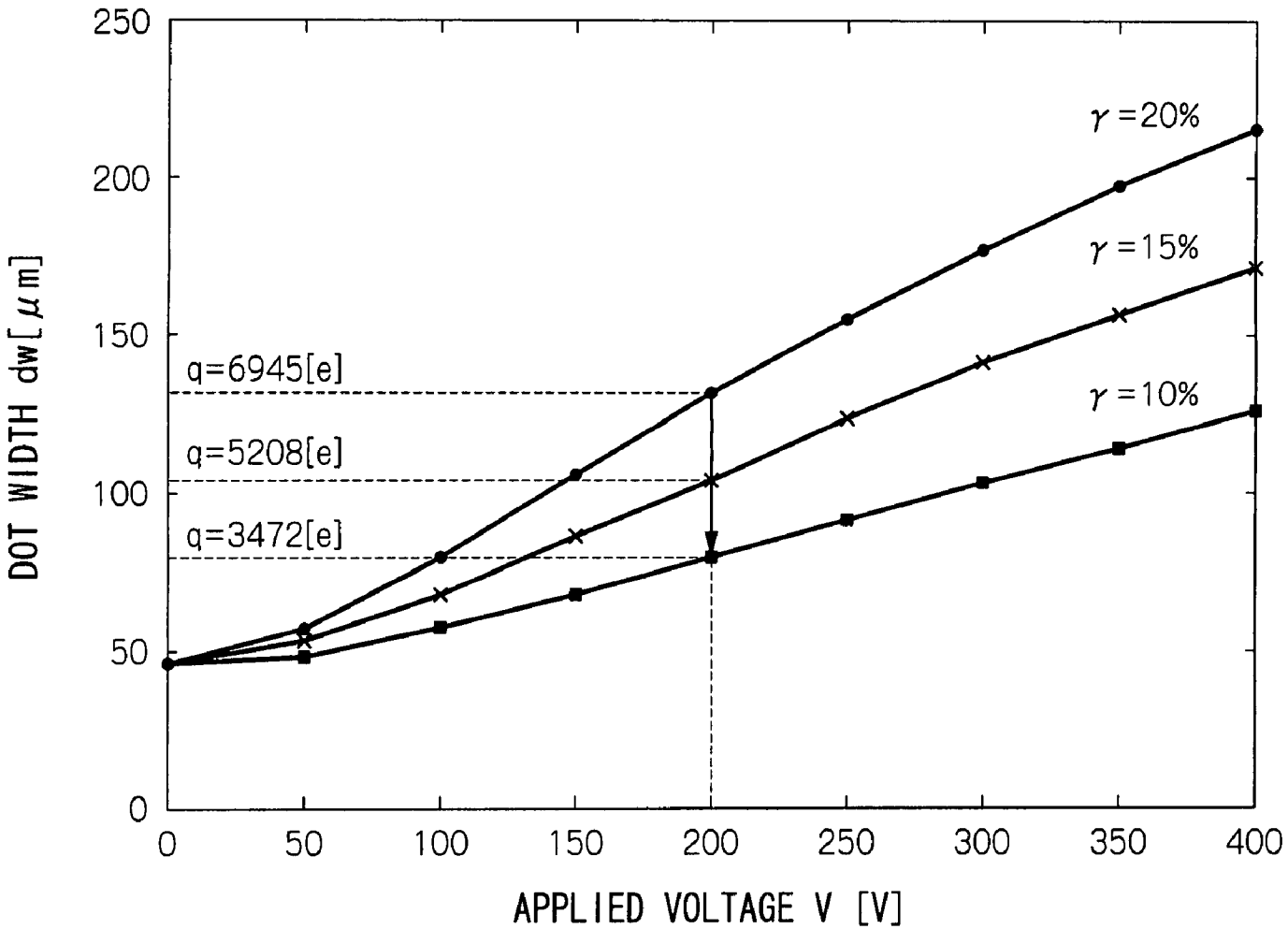
FIG.6 RELATED ART
FIG. 6 is a graph showing the relationship between the applied voltage and the dot diameter as calculated for a model in the related art (integrated charging and acceleration system)

The actions and effects obtained by the embodiments of the present invention are described here on the basis of specific examples, in comparison with the related art which uses integrated charging and acceleration. FIG. 6 is a graph showing the relationship between the applied voltage and the dot diameter calculated on the basis of assumed conditions, for a model of the related art in which the mist charging and acceleration operations are integrated.

The following calculation conditions are used. The electrical discharge conditions indicated in the following Formula (1) for the amount of charge q of the liquid droplets (the ink micro-particles) are assumed taking an initial speed of the liquid droplets (the ink micro-particles) of 30 m/s, a distance between electrodes of 0.5 mm, a nozzle diameter of 50 μm, and a particle size of the liquid droplets of 25 μm:

$$q=4\pi\times\epsilon p\times r^2\times E\times\gamma, \quad (1)$$

where q is the amount of charge, εp is the dielectric constant of the liquid droplets, r is the radius of the liquid droplet (one ink micro-particle), E is the electric field intensity, and γ is a corrective element (for example, γ is a correction coefficient having a value around 10% to 20%).

FIG. 6 shows the result of calculating numerical values of the relationship between the applied voltage and the dot diameter when the conditions in Formula (1) are assumed, on the basis of the Coulomb interaction between the liquid droplets situated on the nozzle surface, at a distance equivalent to one droplet apart. Stokes' approximation is used for the air resistance, and the liquid droplets are assumed to be water (which is the principal component of water-based ink).

The vertical axis of the graph shown in FIG. 6 indicates the dot diameter (width) dw (micrometers), and the horizontal axis indicates the applied voltage V (volts). In the calculation conditions, the distance between electrodes (the gap between the nozzle and the rear surface electrode) is taken to be 0.5 mm, and therefore the value obtained by dividing the applied voltage V on the graph by the distance between electrodes (0.5 mm) gives the electric field intensity E in Formula (1). FIG. 6 shows results which are calculated respectively at γ values of γ=10%, 15% and 20%.

In the case of the integrated charging and acceleration method (in the related art), the amount of charge q on a liquid droplet is directly proportional to the applied voltage V, and therefore, if the applied voltage V is increased, the amount of charge q automatically increases as well. As a result, the acceleration energy rises and the flight time of the ink droplets is shortened. However, looking at FIG. 6, it can be seen that the dot diameter also rises proportionately with the applied voltage V, as the amount of charge q increases with the rise in the applied voltage V, and hence the shortening of the flight time does not contribute to restricting the dot diameter.

On the other hand, even at the same applied voltage, the dot diameter becomes smaller when the value of γ (value corresponding to the ratio of the amount of charge) is reduced. Reducing the value of γ corresponds to reducing the amount of charge q. In other words, if it is possible to suppress the amount of charge q with respect to the applied voltage V, by means of some kind, then it is possible to reduce the dot diameter. As shown in FIG. 6, at 200V, for example, by reducing the amount of charge q to ½ (by changing from the value of q=6945(e) at γ=20%, to the value of q=3472 (e) at γ=10%), the dot diameter can be reduced by one half.

However, if the amount of charge q is simply reduced with respect to a uniform applied voltage V, then the acceleration energy q×V declines, thus leading to prolongation in the flight time of the ink droplets. If the flight time is prolonged, then the printing through-put declines, and giving rise to impediments, such as increased liability to external air disturbance. Consequently, it is necessary to reduce the amount of charge q, while increasing the acceleration voltage (applied voltage V) accordingly, in order to maintain uniform conditions of the acceleration energy, q×V.

From this viewpoint, in the embodiments of the present invention, as shown in FIGS. 1 to 5B, the charging and acceleration functions are either separated spatially (FIGS. 1 to 4), or they are separated temporally (FIGS. 5A and 5B).

Figure 7:
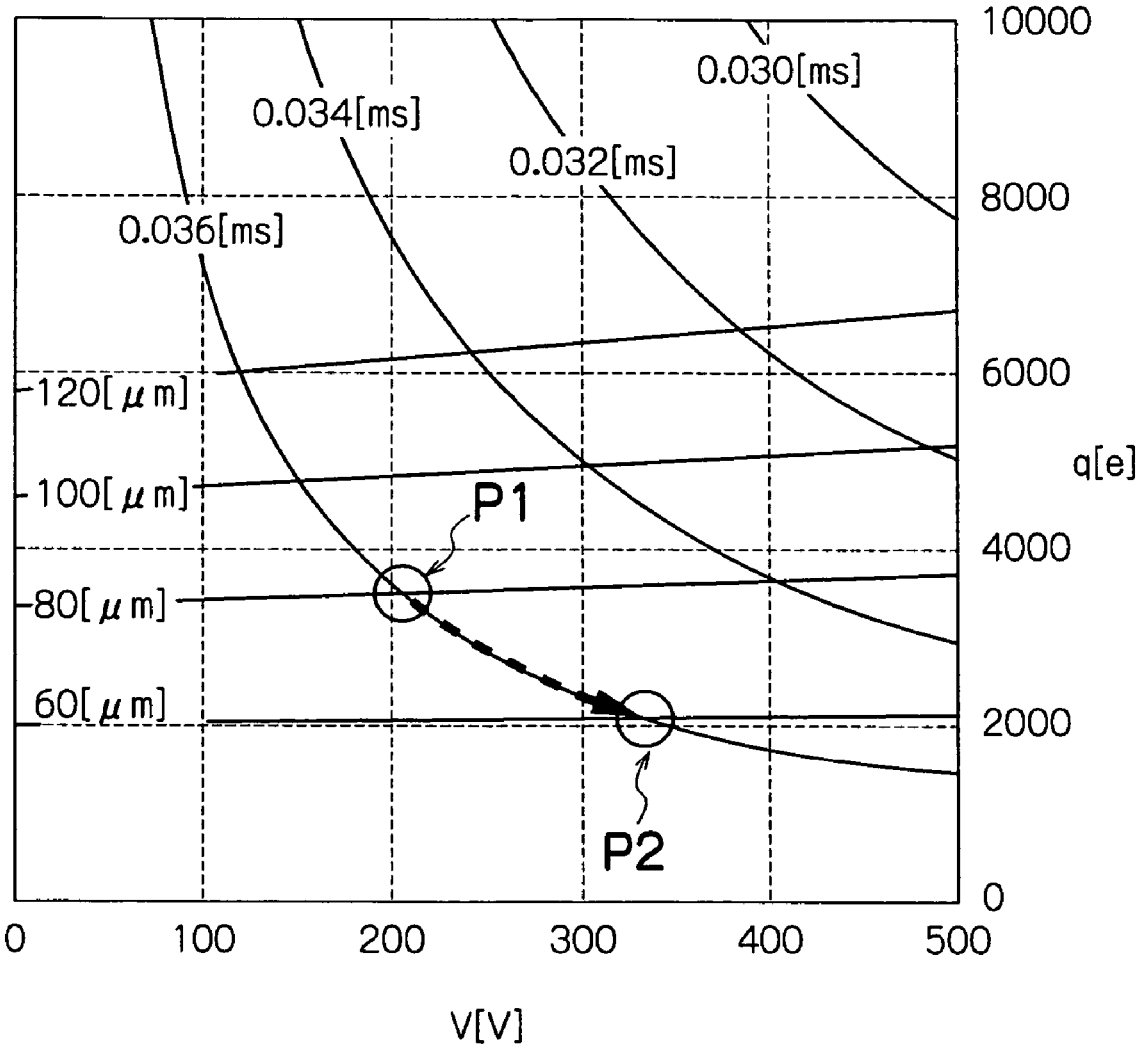
FIG. 7 is a graph showing the relationship between the acceleration voltage and the amount of charge calculated respectively by taking the dot diameter and the flight time as parameters, in respect of a charging and acceleration separation method according to the embodiment of the present invention.

FIG. 7 is a graph showing an example of the effects of the charging and acceleration separation system according to the embodiment of the present invention. This graph shows an example based on the spatial division method shown in FIGS. 1 to 4, in which the horizontal axis indicates the acceleration voltage (acceleration only), and the vertical axis indicates the amount of charge.

FIG. 7 shows a group of four straight lines, which rise (increase) toward the upper right-hand side, and a group of four curved lines, which descend (decrease) toward the lower right-hand side. The group of straight lines indicates the dot diameter, and the group of curved lines indicates the flight time. The respective lines are based on sampling under four sets of conditions.

Here, the points P1 and P2 enclosed in circles in FIG. 7 are considered, as examples. These points P1 and P2 are both situated on a curved line of a flight time of 0.036 ms, and hence they have the same flight time. The fact that they have the same flight time means that substantially the same level of acceleration energy is applied. Comparing the dot diameters, the point P1 has a diameter of 80 μm, whereas the point P2 has a diameter of 60 μm, and hence the dot diameter decreases from P1 to P2. In other words, whereas, at the acceleration voltage of 200 V on the graph, the amount of charge that achieves the dot diameter of 80 μm and the flight time of 0.036 ms is 3500 (e) (the point P1), if the acceleration voltage is raised to 350 V and the amount of charge is reduced to 2000 (e) (the point P2), then the dot diameter can be reduced to 60 μm while maintaining the same flight time of 0.036 ms.

In this way, by reducing the charge on the mist and raising the acceleration voltage accordingly, it is possible to suppress the enlargement of the dot diameter, while maintaining a substantially uniform flight time.

Structural Embodiment of Image Forming Apparatus

Next, an embodiment of an image forming apparatus, which employs the mist spraying apparatus described above as a print head, is described.

Figure 8:
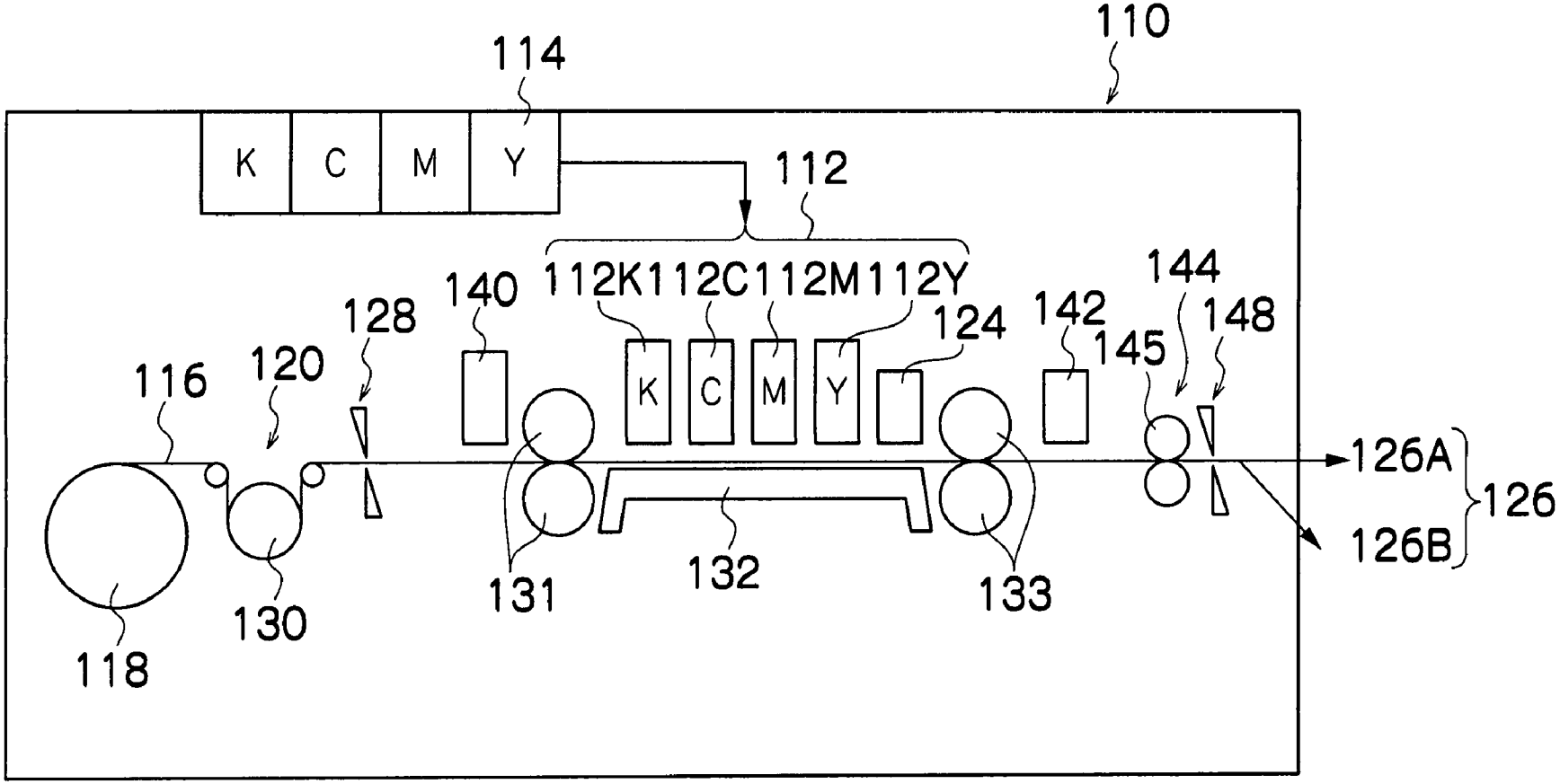
FIG. 8 is a general schematic drawing of an inkjet recording apparatus showing one embodiment of an image forming apparatus according to the present invention.

FIG. 8 is a general configuration diagram of an inkjet recording apparatus according to an embodiment of an image forming apparatus of the present invention. As shown in FIG. 8, the inkjet recording apparatus 110 comprises: a printing unit 112 having a plurality of mist ejection heads (hereafter, called "heads") 112K, 112C, 112M, and 112Y provided for ink colors of black (K), cyan (C), magenta (M), and yellow (Y), respectively; an ink storing and loading unit 114 for storing inks of K, C, M and Y to be supplied to the heads 112K, 112C, 112M, and 112Y; a paper supply unit 118 for supplying recording paper 116 which is a recording medium; a decurling unit 120 removing curl in the recording paper 116; a belt conveyance unit 122 disposed facing the nozzle face (ink-droplet ejection face) of the printing unit 112, for conveying the recording paper 116 while keeping the recording paper 116 flat; a print determination unit 124 for reading the printed result produced by the printing unit 112; and a paper output unit 126 for outputting image-printed recording paper (printed matter) to the exterior.

The ink storing and loading unit 114 has ink tanks for storing the inks of K, C, M and Y to be supplied to the heads 112K, 112C, 112M, and 112Y, and the tanks are connected to the heads 112K, 112C, 112M, and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 8, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium (medium) can be used, it is preferable that an information recording medium such as a bar code and a wireless tag containing information about the type of medium is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 8, and the continuous paper is cut into a desired size by the cutter 128. When cut papers are used, the cutter 128 is not required.

After decurling, the cut recording paper 116 is nipped and conveyed by the pair of conveyance rollers 131, and is supplied onto the platen 132. A pair of conveyance rollers 133 is also disposed on the downstream side of the platen 132 (the downstream side of the print unit 112), and the recording paper 116 is conveyed at a prescribed speed by the joint action of the front side pair of conveyance rollers 131 and the rear side pair of conveyance rollers 133.

The platen 132 functions as a member which holds (supports) the recording paper 116 while keeping the recording paper 116 flat (a recording medium holding device), as well as being a member which functions as the rear surface electrode 34 shown in FIG. 1 and the like. The platen 132 in FIG. 8 has a width dimension which is greater than the width of the recording paper 116, and at least the portion of the platen 132 opposing the nozzle surface of the print unit 112 and the sensor surface of the print determination unit 124 is a horizontal surface (flat surface).

A heating fan 140 is disposed on the upstream side of the printing unit 112 in the conveyance pathway of the recording paper 116. The heating fan 140 blows heated air onto the recording paper 116 to heat the recording paper 116 immediately before printing so that the ink deposited on the recording paper 116 dries more easily.

Figure 9:
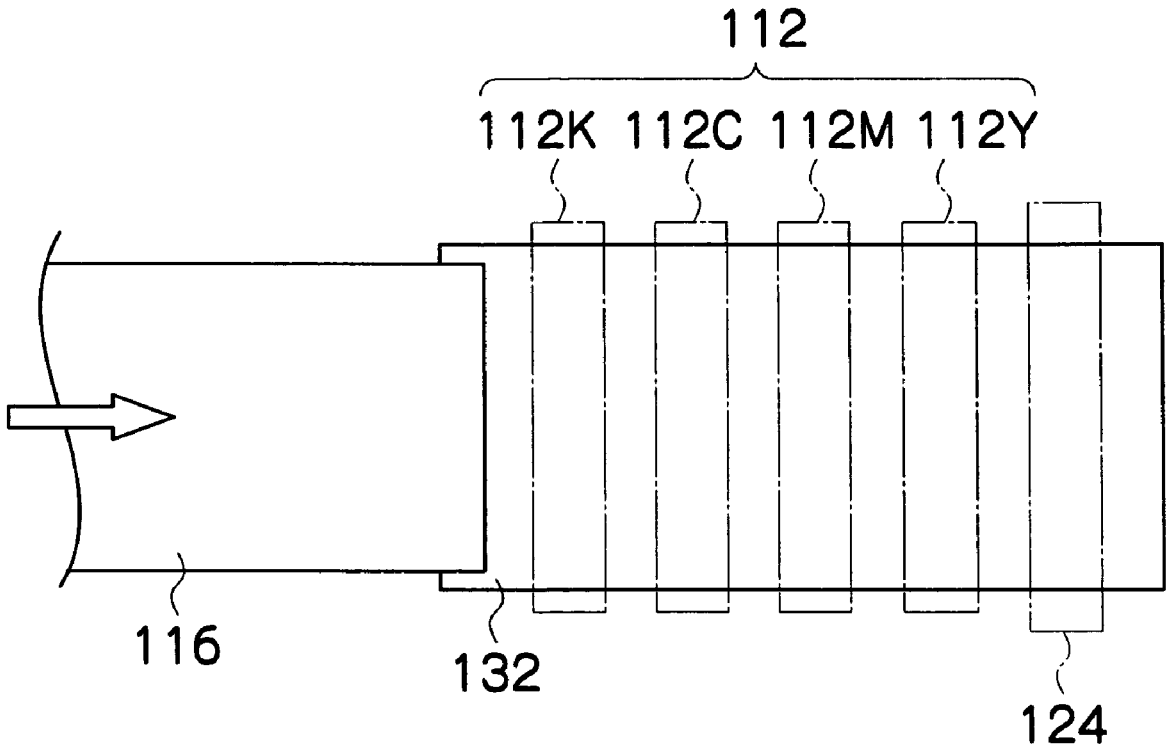
FIG. 9 is a principal plan diagram of the peripheral area of a print unit in the inkjet recording apparatus illustrated in FIG. 8.

The heads 112K, 112C, 112M and 112Y of the printing unit 112 are full line heads having a length corresponding to the maximum width of the recording paper 116 used with the inkjet recording apparatus 110, and comprising a plurality of nozzles for ejecting ink arranged on the nozzle face through a length exceeding at least one edge of the maximum-size recording paper (namely, the full width of the printable range) (see FIG. 9).

The heads 112K, 112C, 112M and 112Y are arranged in color order of black (K), cyan (C), magenta (M), yellow (Y) from the upstream side in the feed direction of the recording paper 116, and these heads 112K, 112C, 112M and 112Y are fixed extending in a direction substantially perpendicular to the conveyance direction of the recording paper 116.

A color image can be formed on the recording paper 116 by ejecting inks of different colors from the heads 112K, 112C, 112M and 112Y, respectively, onto the recording paper 116 while the recording paper 116 is conveyed by the belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation of relatively moving the recording paper 116 and the printing unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which heads for ejecting light-colored inks such as light cyan and light magenta are added. Furthermore, there are no particular restrictions of the sequence in which the heads of respective colors are arranged.

The print determination unit 124 illustrated in FIG. 8 has an image sensor (line sensor or area sensor) for capturing an image of the droplet ejection result of the print unit 112, and functions as a device to check for ejection defects such as blockages, landing position displacement, and the like, of the nozzles from the image of deposited droplets read in by the image sensor. A test pattern or the target image printed by the heads 112K, 112C, 112M, and 112Y of the respective colors is read in by the print determination unit 124, and the ejection performed by each head is determined. The ejection determination includes the presence of the ejection, measurement of the dot size, and measurement of the dot landing position.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 8, the paper output unit 126A for the target prints is provided with a sorter for collecting prints according to print orders.

Structure of Head

Next, the structure of the head is described. The heads 112K, 112C, 112M and 112Y of the respective ink colors have the same structure, and a reference numeral 150 is hereinafter designated to any of the heads.

Figure 10:
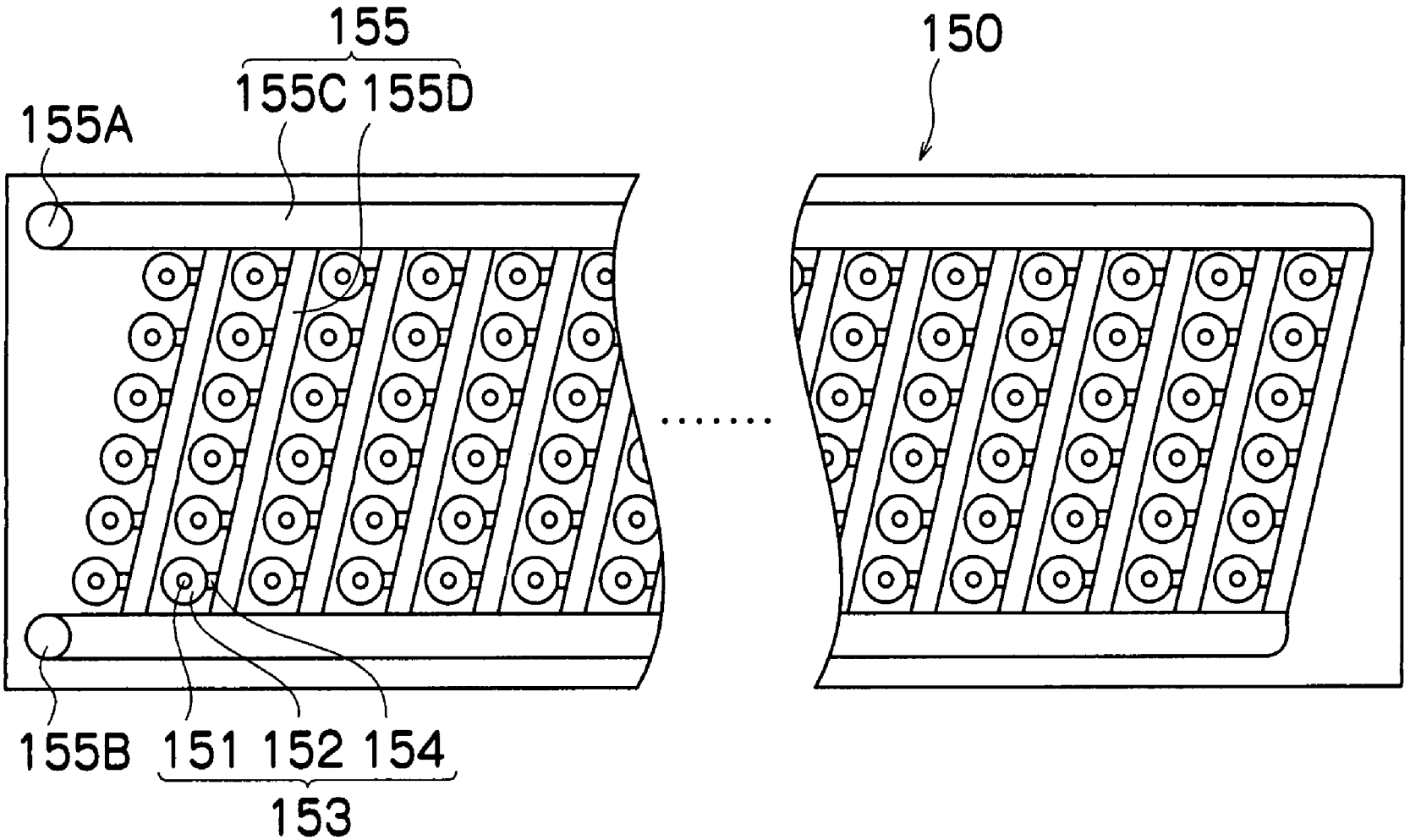
FIG. 10 is a plan view perspective diagram showing the internal structure of a print head.

FIG. 10 is a plan view perspective diagram showing the internal structure of the head 150. In order to achieve a high resolution (small pitch) of the dots printed onto the surface of the recording paper 116, it is necessary to achieve a high density (small pitch) of the nozzles in the head 150. As shown in FIG. 10, the head 150 according to the present embodiment has a structure in which a plurality of ink chamber units (liquid droplet ejection elements) 153, each having a nozzle 151 forming an ink ejection port, an ink chamber 152 corresponding to the nozzle 151, and the like, are disposed (two-dimensionally) in the form of a staggered matrix, and hence the effective nozzle interval (the projected nozzle pitch) as projected in the lengthwise direction of the head (the direction perpendicular to the paper conveyance direction) is reduced (high nozzle density is achieved). In FIG. 10, in order to simplify the drawing, the number of channels (number of ink chamber units 153) is omitted from the drawing.

The ink chambers 152 of the respective channels are connected to a common flow channel 155 through individual supply paths 154. The common flow channel 155 is connected to an ink tank which forms an ink source (not shown in FIG. 10 and equivalent to the ink storing and loading unit 114 shown in FIG. 8), through connection ports 155A and 155B, and the ink supplied from the ink tank is distributed and supplied to the ink chambers 152 of the respective channels through the common flow channel 155 in FIG. 10. The reference numeral 155C in FIG. 10 indicates a main channel of the common flow channel 155 and 155D indicates a distributary channel which branches off from the main channel 155C.

To give a brief description of the correspondence of the head 150 shown in FIG. 10 to the composition shown in FIGS. 1 to 5B, the nozzles 151, the ink chambers 152 and the individual supply paths 154 in FIG. 10 correspond respectively to the nozzles 12, the ink chambers 14 and the ink supply ports 16 shown in FIGS. 1 to 5B. Furthermore, in FIG. 10, the distributary channels 155D of the common flow channel 155 correspond to the common flow channel 18 shown in FIG. 1.

The detailed structure of the respective ink chamber units 153 in FIG. 10 is similar to that described in FIGS. 1 to 5B. FIGS. 1 and 2 show a structure in which the piezoelectric body 22A and the individual electrode 22C constituting the piezoelectric element 22 are separated into independent element units, but it is also possible to adopt a structure in which a piezoelectric body layer is formed integrally (as a single plate), without being separated into element units, and the individual electrodes are separated (by patterning into element units), in such a manner that a plurality of piezoelectric elements are formed which respectively use the regions of the piezoelectric body in the areas of their individual electrodes as active sections.

Figure 11:
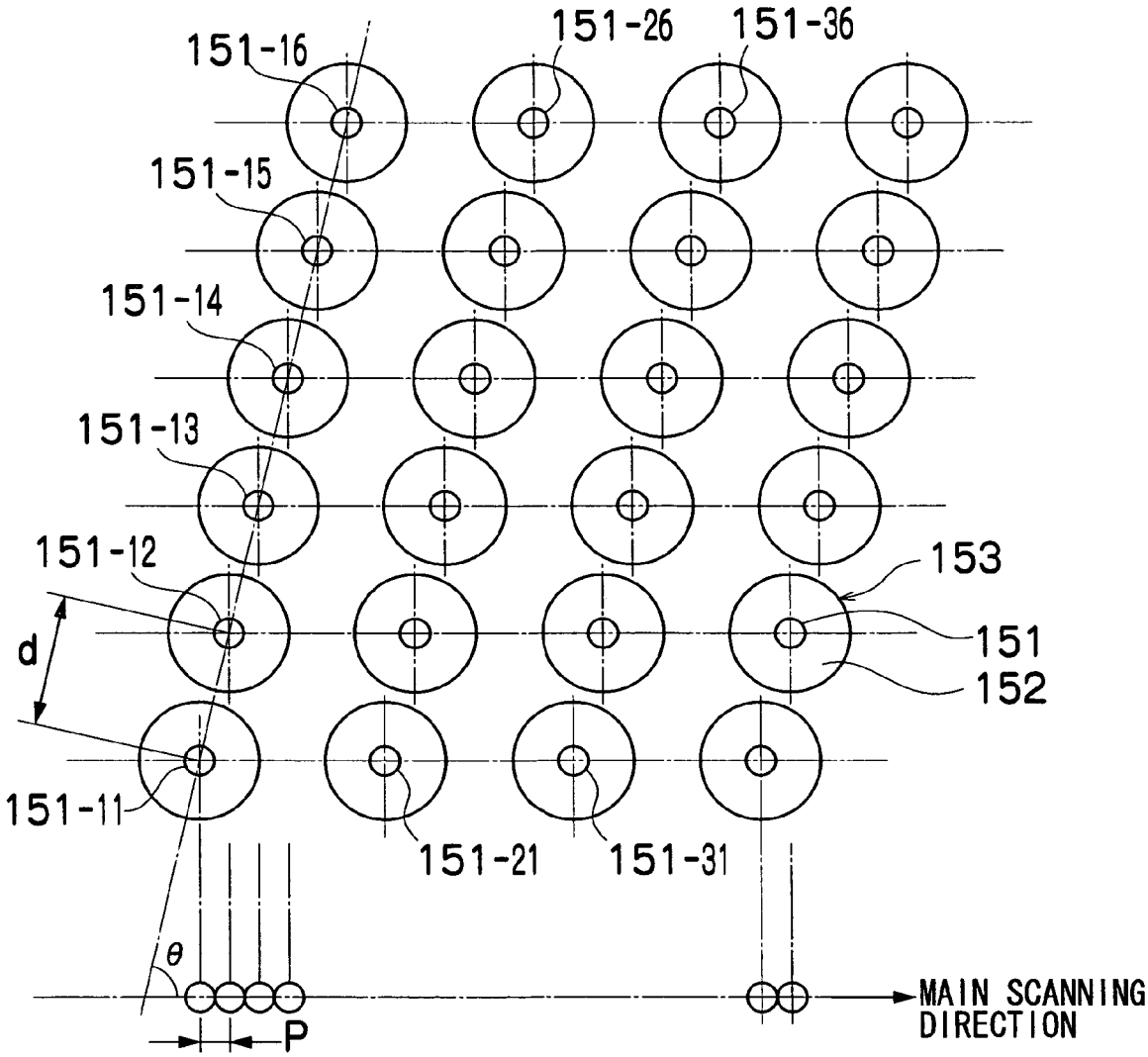
FIG. 11 is an enlarged diagram of the structural arrangement of ink chamber units in the head shown in FIG. 10.

FIG. 11 is an enlarged diagram of the structural arrangement of the ink chamber units 153 in the head 150 shown in FIG. 10. As shown in FIG. 11, the high-density nozzle head according to the present embodiment is achieved by arranging a plurality of ink chamber units 153 in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 153 are arranged at a uniform pitch d in line with a direction forming the angle of θ with respect to the main scanning direction, the pitch P of the nozzles projected so as to align in the main scanning direction is d×cos θ, and hence the nozzles 151 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 151 arranged in a matrix such as that shown in FIG. 11 are driven, the main scanning according to the above-described (3) is preferred. More specifically, the nozzles 151-11, 151-12, 151-13, 151-14, 151-15 and 151-16 are treated as a block (additionally; the nozzles 151-21, . . . , 151-26 are treated as another block; the nozzles 151-31, . . . , 151-36 are treated as another block; . . . ); and one line is printed in the width direction of the recording paper 116 by sequentially driving the nozzles 151-11, 151-12, . . . , 151-16 in accordance with the conveyance velocity of the recording paper 116.

On the other hand, "sub-scanning" is defined as to repeatedly perform printing of one line (a line formed of a row of dots, or a line formed of a plurality of rows of dots) formed by the main scanning, while moving the full-line head and the recording paper 116 relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording paper 116 is called the sub-scanning direction and the direction perpendicular to same is called the main scanning direction.

Figure 12:
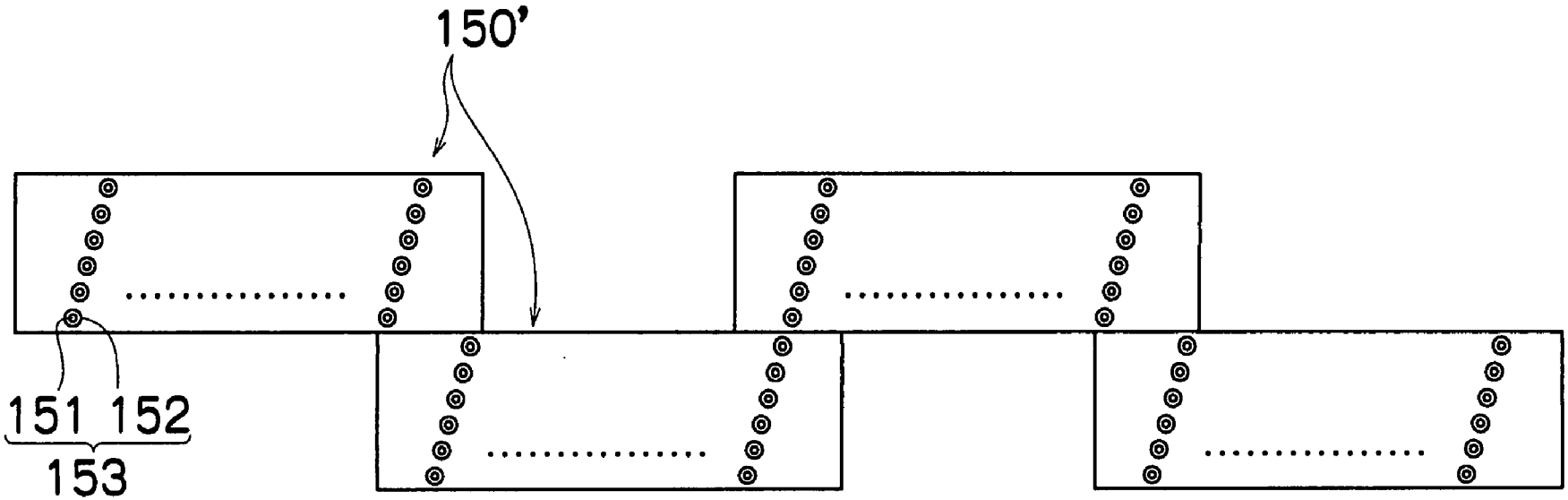
FIG. 12 is a plan view perspective diagram showing a further embodiment of the composition of a full line head.

In implementing the present invention, the nozzle arrangement structure is not limited to the embodiment shown in FIGS. 10 and 11. For example, in one mode of a full line head which has a nozzle row extending through a length corresponding to the full width of the recording paper 116 in a direction substantially perpendicular to the conveyance direction of the recording paper 116, instead of the composition shown in FIG. 10, it is possible to compose a line head having a nozzle row of a length corresponding to the full width of the recording paper 116 by joining together, in a staggered matrix arrangement, a plurality of short head blocks 150', each comprising a plurality of nozzles 151 arranged in a two-dimensional configuration, as shown in FIG. 12.

Description of Control System

Figure 13:
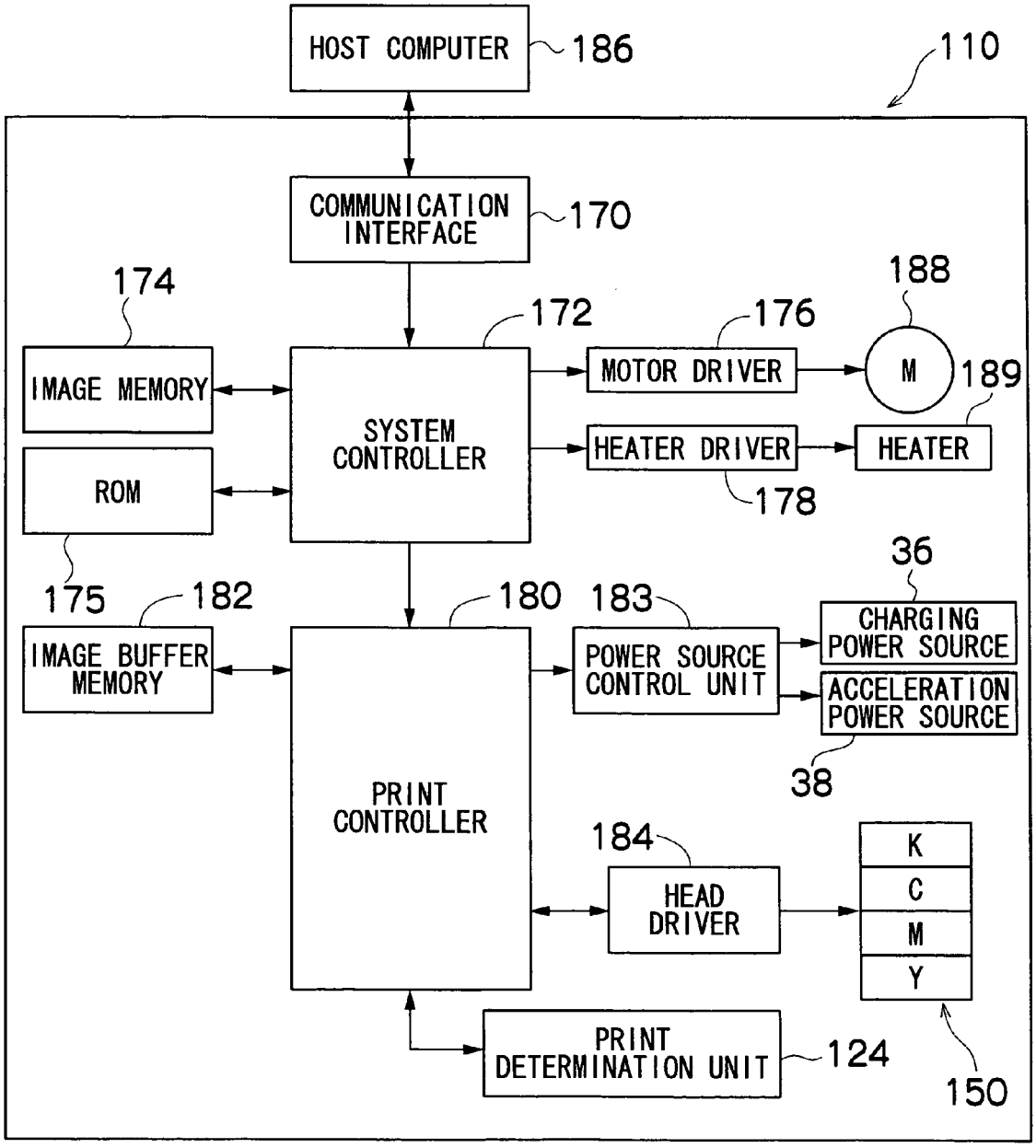
FIG. 13 is a principal block diagram showing the system composition of an inkjet recording apparatus according to the present embodiment.

FIG. 13 is a block diagram showing the system configuration embodiment of the inkjet recording apparatus 110. In the configuration shown in FIG. 13, the heads according to the spatial division method explained with reference to FIGS. 1 to 4 are employed. As shown in FIG. 13, the inkjet recording apparatus 110 comprises a communication interface 170, a system controller 172, an image memory 174, a ROM 175, a motor driver 176, a heater driver 178, a print controller 180, an image buffer memory 182, a power source control unit 183, a head driver 184, and the like.

The communication interface 170 is an interface unit (image input device) for receiving image data sent from a host computer 186. A serial interface such as USB, IEEE 1394, Ethernet, wireless network, or a parallel interface such as a Centronics interface may be used as the communication interface 170. A buffer memory (not shown) may be mounted in this portion in order to increase the communication speed.

The image data sent from the host computer 186 is received by the inkjet recording apparatus 110 through the communication interface 170, and is temporarily stored in the image memory 174. The image memory 174 is a storage device for storing images inputted through the communication interface 170, and data is written and read to and from the image memory 174 through the system controller 172. The image memory 174 is not limited to a memory composed of semiconductor elements, and a hard disk drive or another magnetic medium may be used.

The system controller 172 is constituted by a central processing unit (CPU) and peripheral circuits thereof, and the like, and it functions as a control device for controlling the whole of the inkjet recording apparatus 110 in accordance with a prescribed program, as well as a calculation device for performing various calculations. More specifically, the system controller 172 controls the various sections, such as the communication interface 170, image memory 174, motor driver 176, heater driver 178, and the like, as well as controlling communications with the host computer 186 and writing and reading to and from the image memory 174 and ROM 175, and it also generates control signals for controlling the motor 188 and heater 189 of the conveyance system. The motor 188 of the conveyance system is a motor which applies a drive force to the drive rollers of the pairs of conveyance rollers 131 and 133 shown in FIG. 8, for example. Furthermore, the heater 189 in FIG. 13 is a heating device which is used in the heating drum 130, heating fan 140 or post drying unit 142, as shown in FIG. 8.

The program executed by the CPU of the system controller 172 and the various types of data which are required for control procedures are stored in the ROM 175. The ROM 175 may be a non-writeable storage device, or it may be a rewriteable storage device, such as an EEPROM. The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. The heater driver (drive circuit) 178 drives the heater 189 in accordance with commands from the system controller 172.

The print controller 180 functions as a signal processing device which generates dot data for the inks of respective colors on the basis of the input image. More specifically, the print controller 180 is a control unit which performs various treatment processes, corrections, and the like, in accordance with the control implemented by the system controller 172, in order to generate a signal for controlling ink droplet ejection, from the image data in the image memory 174, and it supplies the print data (dot data) thus generated to the head driver 184.

The image buffer memory 182 is provided in the print controller 180, and image data, parameters, and other data are temporarily stored in the image buffer memory 182 when the image is processed in the print controller 180. FIG. 13 shows a mode in which the image buffer memory 182 is attached to the print controller 180; however, the image memory 174 may also serve as the image buffer memory 182. Also possible is a mode in which the print controller 180 and the system controller 172 are integrated to form a single processor.

A power source control unit 183 is constituted by a control circuit which controls the on/off switching and the output voltage of the charging power source 36 and the acceleration power source 38 (see FIGS. 3 and 4). The power source control unit 183 controls the output of the charging power source 36 and the acceleration power source 38 in accordance with commands from the print controller 180.

To give a general description of the sequence of processing from image input to print output, image data to be printed (original image data) is input from an external source through a communications interface 170, and is accumulated in the image memory 174. At this stage, RGB image data is stored in the image memory 174, for example.

In this inkjet recording apparatus 110, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 174 is sent to the print controller 180 through the system controller 172, and is converted to the dot data for each ink color by a half-toning technique, using dithering, error diffusion, or the like, in the print controller 180.

In other words, the print controller 180 performs processing for converting the input RGB image data into dot data for the four colors of K, C, M and Y. In this way, the dot data generated by the print controller 180 is stored in the image buffer memory 182.

The head driver 184 outputs drive signals for driving the piezoelectric elements 22 corresponding to the respective nozzles 151 of the head 150, on the basis of the ink dot data supplied by the print controller 180 (in other words, the ink dot data stored in the image buffer memory 182). In other words, the combination of the print controller 180 and the head driver 184 functions as a device corresponding to the "drive control device" of the present invention. A feedback control system for maintain uniform driving conditions in the head may also be incorporated into the head driver 184.

The prescribed charging voltage V1 is applied to the charging voltage of the head 150 (the nozzle plate 24 shown in FIGS. 1 to 4) from the charging power source 36, and the prescribed acceleration voltage V2 (V1<V2) is applied to the acceleration electrode 28 (shown in FIGS. 1 to 4) of the head 150 from the acceleration power source 38, in addition to which a drive signal output from the head driver 184 is applied to the head 150, whereby an ink mist is ejected from the corresponding nozzle 151. By controlling ink ejection from the head 150 in synchronization with the conveyance speed of the recording paper 116, an image is formed on the recording paper 116.

As described above, the ejection volume and the ejection timing of the liquid droplets from the head 150 are controlled, on the basis of the dot data generated by implementing prescribed signal processing in the print controller 180. By this means, prescribed dot size and dot positions can be achieved.

The print determination unit 124 is a block that includes the image sensor as described above with reference to FIG. 8, reads the image printed on the recording paper 116, determines the print conditions (presence of the ejection, variation in the dot formation, optical density, and the like) by performing desired signal processing, or the like, and provides the determination results of the print conditions to the print controller 180. Instead of or in conjunction with this print determination unit 124, it is also possible to provide another ejection determination device (corresponding to an ejection abnormality determination device).

As a further ejection determination device, it is possible to adopt, for example, a mode (internal determination method) in which a pressure sensor is provided inside or in the vicinity of each ink chamber 152 of the head 150, and ejection abnormalities are determined from the determination signals obtained from these pressure sensors when ink is ejected or when the piezoelectric elements are driven in order to measure the pressure. Alternatively, it is also possible to adopt a mode (external determination method) using an optical determination system comprising a light source, such as laser light emitting element, and a photoreceptor element, whereby light, such as laser light, is irradiated onto the ink droplets ejected from the nozzles and the droplets in flight are determined by means of the transmitted light quantity (received light quantity).

The print controller 180 implements various corrections (correction of the ejection volume, correction of the ejection position, and the like), with respect to the head 150, on the basis of the information obtained from the print determination unit 124 or another ejection determination device (not illustrated), according to requirements, and it implements control for carrying out cleaning operations (nozzle restoring operations), such as preliminary ejection, (which may also be called "purging", "dummy ejection", "blank ejection", or the like), nozzle suctioning, or wiping, as and when necessary.

According to the inkjet recording apparatus 110 having the composition described above, it is possible to form dots of a small dot diameter compared to the related art, and hence an image of high resolution can be formed.

Figure 14:
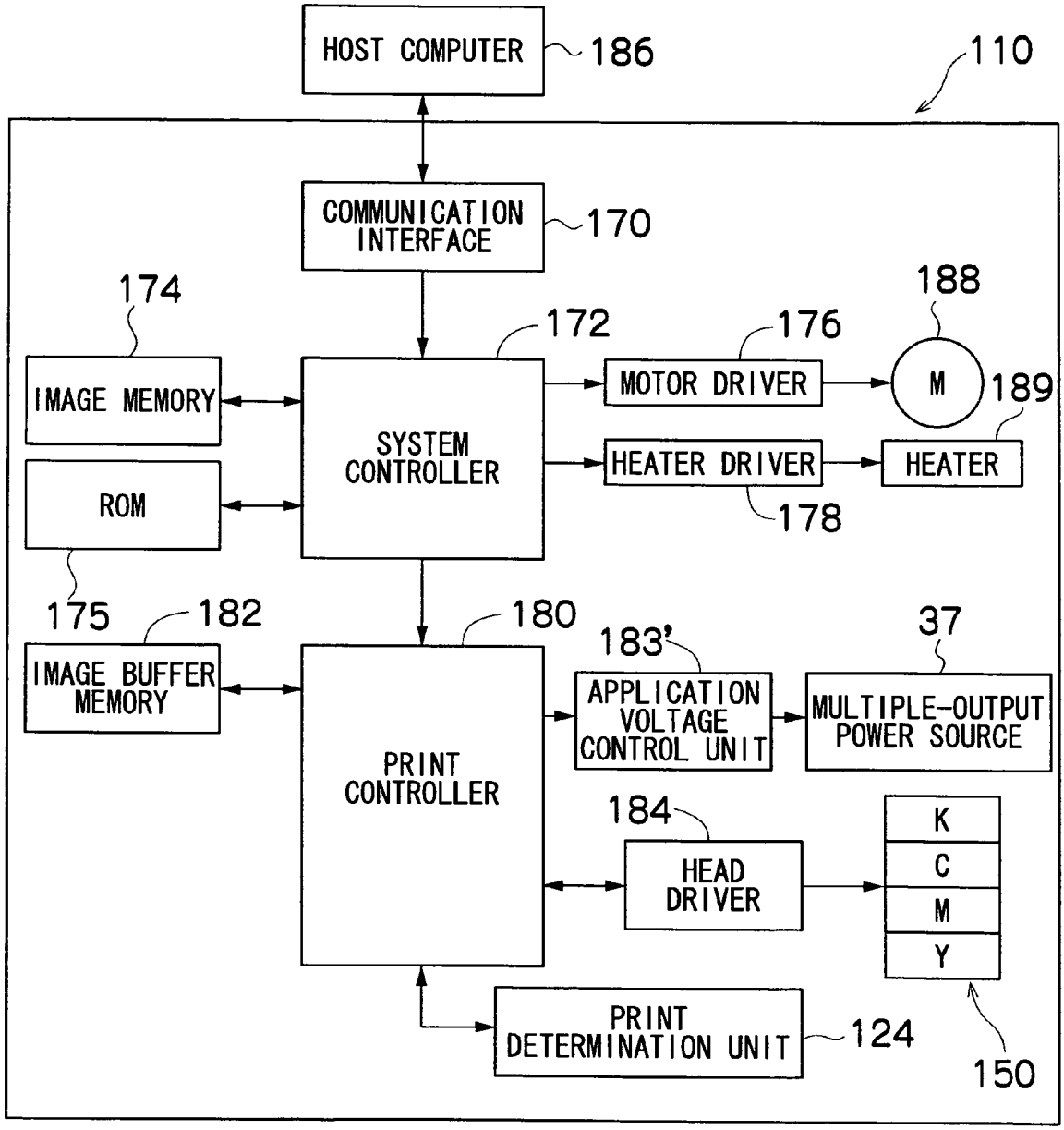
FIG. 14 is a principal block diagram showing the system composition of an inkjet recording apparatus according to another embodiment.

FIG. 14 is a block diagram showing a further embodiment of the system composition of the inkjet recording apparatus 110. The composition shown in FIG. 14 is the same as that using the head based on the temporal division method as shown in FIGS. 5A and 5B. In FIG. 14, items which are the same as or similar to the composition in FIG. 13 are denoted with the same reference numerals and description thereof is omitted here.

Instead of the charging power source 36, the acceleration power source 38, and the power source control unit 183 controlling these power sources in FIG. 13, the present embodiment is provided with the multiple-output power source 37 and an application voltage control unit 183' for controlling the multiple-output power source 37 as shown in FIG. 14.

The application voltage control unit 183' is constituted by a control circuit which controls the output voltage of the multiple-output power source 37. The application voltage control unit 183' outputs a control signal which switches between the output of the charging voltage and the output of the acceleration voltage, in synchronism with the drive timing of the piezoelectric element 22 (the timing at which ink particles in the form of a mist is sprayed described with reference to FIGS. 5A and 5B), in accordance with instructions from the print controller 180. The output voltage of the multiple-output power source 37 is changed on the basis of the control signal from the application voltage control unit 183', thereby switching the voltage applied to the nozzle plate 24 (the charging and acceleration electrode).

The multiple-output power source 37 corresponds to the "voltage application device" of the present invention, and the combination of the print controller 180 and the applied voltage control unit 183' corresponds to the "electric field control device" of the present invention.

According to this composition, it is possible to form dots of a small dot diameter compared to the related art, and an image of high resolution can be formed.

Moreover, as a modification of the embodiment described above, it is also possible to adopt a mode which combines the spatial division method with the temporal division method. In this case, the composition of the apparatus uses the electrode arrangement according to the spatial division method shown in FIGS. 1 to 4, and it implements similar control to that of the temporal division method, for controlling the application of voltage to the respective electrodes.

Furthermore, the inkjet recording apparatus is described in the foregoing explanation as one embodiment of the image forming apparatus, but the scope of application of the present invention is not limited to this. For example, the mist spraying apparatus according to the present invention may also be applied to a photographic image forming apparatus in which developing solution is applied onto a printing paper by means of a non-contact method. Furthermore, the scope of application of the mist spraying apparatus according to the present invention is not limited to an image forming apparatus, and the present invention may also be applied to various other types of apparatuses which spray a processing liquid, chemical solution, or other liquid, toward a liquid receiving medium by means of a mist ejection head (spray head), (such as a coating apparatus, or the like).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A mist spraying apparatus, comprising:

a pressure chamber into which liquid is filled;

a charging electrode which is in contact with the liquid and charges the liquid;

a vibration generating device which converts the liquid into droplets by applying vibrational energy to the liquid inside the liquid chamber, thereby generating a charged mist;

a rear surface electrode which is disposed so as to oppose an ejection surface including an ejection port ejecting the charged mist, and holds an liquid receiving medium onto which the charged mist is deposited from the ejection port;

an acceleration electrode which is disposed at a position separated by a prescribed distance in an outward radial direction from an edge of the ejection port, and generates an electric field for acceleration between the acceleration electrode and the opposing rear surface electrode;

a charging voltage application device which applies a charging voltage to the charging electrode; and an acceleration voltage application device which applies an acceleration voltage that is higher than the charging voltage to the acceleration electrode, thereby generating, between the acceleration electrode and the rear surface electrode, the electric field for acceleration having an electric field intensity which is greater than an electric field intensity generated between the charging electrode and the rear surface electrode by the voltage applied from the charging voltage application device.

2. The mist spraying apparatus as defined in claim 1, wherein a nozzle plate in which the ejection port is formed functions as the charging electrode.

3. The mist spraying apparatus as defined in claim 1, wherein an insulating layer is provided between the charging electrode and the acceleration electrode.

4. The mist spraying apparatus as defined in claim 1, wherein:

the vibration generating device is constituted by a piezoelectric element; and a drive control device is provided to output a drive signal which causes the piezoelectric element to vibrate ultrasonically.

5. An image forming apparatus comprising the mist spraying apparatus as defined in claim 1, which forms an image on the liquid receiving medium by means of the droplets ejected from the ejection ports.

6. A mist spraying apparatus, comprising:

a pressure chamber into which liquid is filled;

a charging and acceleration electrode which is in contact with the liquid and selectively applies a charging voltage for charging the liquid, and an acceleration voltage which generates an acceleration electric field for accelerating a charged mist ejected from an ejection port;

a vibration generating device which converts the liquid into droplets by applying vibrational energy to the liquid inside the liquid chamber, thereby generating the charged mist;

a rear surface electrode which is disposed so as to oppose an ejection surface including the ejection port ejecting the charged mist, and holds a liquid receiving medium onto which the charged mist is deposited from the ejection port;

a voltage application device which selectively applies the charging voltage and the acceleration voltage that is higher than the charging voltage, to the charging and acceleration electrode; and an electric field control device which controls, by temporal division, the voltage applied to the charging and acceleration electrode by the voltage application device, thereby generating an electric field of a first electric field intensity between the charging and acceleration electrode and the rear surface electrode, during application of the charging voltage, and generating an acceleration electric field of a second electric field intensity that is greater than the first electric field intensity, between the charging and acceleration electrode and the rear surface electrode, during application of the acceleration voltage.

7. The mist spraying apparatus as defined in claim 6, wherein a nozzle plate in which the ejection port is formed functions as the charging and acceleration electrode.

8. The mist spraying apparatus as defined in claim 6, wherein:

the vibration generating device is constituted by a piezoelectric element; and a drive control device is provided to output a drive signal which causes the piezoelectric element to vibrate ultrasonically.

9. An image forming apparatus comprising the mist spraying apparatus as defined in claim 6, which forms an image on the liquid receiving medium by means of the droplets ejected from the ejection ports.

10. A mist spraying method, comprising the steps of:

charging liquid filled in a liquid chamber by applying a charging voltage to a charging electrode which is in contact with the liquid, and generating a charged mist by converting the liquid into droplets by applying a vibrational energy to the liquid;

ejecting the charged mist from an ejection port toward a liquid receiving medium held on a rear surface electrode disposed so as to oppose an ejection surface including the ejection port of the charged mist;

generating, between an acceleration electrode and the rear surface electrode, an acceleration electric field of an electric field intensity greater than an electric field intensity generated between the charging electrode and the rear surface electrode, by applying an acceleration voltage that is higher than the charging voltage, to the acceleration electrode which is separated by a prescribed distance in an outward radial direction from an edge of the ejection port; and depositing the charged mist on the liquid receiving medium, by accelerating the charged mist by means of electrostatic force of the acceleration electric field.

11. A mist spraying method, comprising the steps of:

charging liquid filled in a liquid chamber by applying a charging voltage to a charging and acceleration electrode which is in contact with the liquid, and generating a charged mist by converting the liquid into droplets by applying a vibrational energy to the liquid;

ejecting the charged mist from an ejection port toward a liquid receiving medium held on a rear surface electrode disposed so as to oppose an ejection surface including the ejection port of the charged mist;

controlling a voltage applied to the charging and acceleration electrode, by temporal division, and thereby selectively applying the charging voltage, and an acceleration voltage that is higher than the charging voltage, to the charging and acceleration electrode;

generating an electric field of a first electric field intensity between the charging and acceleration electrode and the rear surface electrode, during application of the charging voltage, and generating an acceleration electric field of a second electric field intensity that is greater than the first electric field intensity, between the charging and acceleration electrode and the rear surface electrode, during application of the acceleration voltage; and depositing the charged mist on the liquid receiving medium, by accelerating the charged mist by means of electrostatic force of the acceleration electric field.

* * * * *